US007311609B2

(12) United States Patent
Mesika

(10) Patent No.: US 7,311,609 B2
(45) Date of Patent: Dec. 25, 2007

(54) MINIATURE SPOOLING APPARATUS

(76) Inventor: Yigal Mesika, 7245 Hillside Ave., #310, Los Angeles, CA (US) 90046

( * ) Notice: Subject to any disclaimer, the term of this patent is extended or adjusted under 35 U.S.C. 154(b) by 0 days.

(21) Appl. No.: 11/093,252

(22) Filed: Mar. 29, 2005

(65) Prior Publication Data

US 2006/0264261 A1 Nov. 23, 2006

(51) Int. Cl.
*A63J 23/00* (2006.01)
*A63J 21/00* (2006.01)

(52) U.S. Cl. ..... 472/55; 472/81

(58) Field of Classification Search ..... 472/51–55, 472/71, 81; 446/228, 229, 424, 484, 491
See application file for complete search history.

(56) References Cited

U.S. PATENT DOCUMENTS

| | | | | |
|---|---|---|---|---|
| 4,389,132 | A * | 6/1983 | Valadez | 401/195 |
| 5,584,195 | A * | 12/1996 | Liu | 63/1.12 |
| 6,209,548 | B1 * | 4/2001 | Harrison et al. | 132/74.5 |
| 6,247,864 | B1 * | 6/2001 | Walsh | 401/195 |
| 6,447,298 | B1 * | 9/2002 | Bhatt et al. | 434/85 |
| 6,601,631 | B1 * | 8/2003 | Miller et al. | 156/577 |

* cited by examiner

*Primary Examiner*—Kien T Nguyen

(57) ABSTRACT

A miniature electrically powered thread reel and precision spooling mechanism fully and discretely hidden inside the cap of a working ink pen. Primarily intended for use by magicians during routines that require a super-thin thread be used for secretly controlling the motion of small objects. The device is completely self-contained and internally houses all necessary components required for normal and reliable functioning. The reel mechanism consists of a spool, spool-cap, motor, motor-housing, switch, battery, electrical contacts, and connective wiring. The main body of the pen is split into two primary sections and is retractable in length. This specialized body configuration is required because the cap contains the reel mechanism, and as a result is not hollow like an ordinary pen cap, so the body of the pen is segmented allowing the halves to slide together. Collapsing the body compensates for lack of space in the cap by shortening the overall pen length, and allows the cap to be put on and taken of without revealing the specialized nature of the device. An internal spring causes the hidden section to telescope out quickly as the cap is taken off, and this gives the appearance of a regular full-length pen being removed from a normal cap. The pen body has a secret compartment for holding an extra replacement thread-spool. The batteries and ink cartridge are standard size and can be replaced when needed. Other than the features described above the device looks and functions like a standard ink pen.

13 Claims, 3 Drawing Sheets

Exploded layout detail of the invention

Exploded layout detail of the invention

Diagram is a side view detailing the relationship of the inventions spool (pictured in red) and the cap cover apparatus. Also shows the shape of the notch in the side of the cover apparatus through which the thread spools.

MINIATURE SPOOLING APPARATUS

BACKGROUND

1. Field of the Invention

The invention relates to props and gimmicks used in the field of magic, carried on the person or hidden in the clothing of the magician, and used to create the illusion of controlling an object with no visible means to do so.

The invention further relates to devices such as reels used for transferring physical force from a power source, for example a motor or engine, through a connective medium for example a rope or thread, to a given object for the purpose controlling or affecting the motion or momentum of said object.

The invention further relates to non-disposable ballpoint ink pens whose housings can be opened in order to replace the ink cartridge, although the invention does not fall clearly into the category of a retractable ink pen, or into the category of a pen in which a is used to keep the ink fresh.

The invention further relates to personal hand-held items that retract in size or length for convince or utility, and can subsequently be caused to expand when used or needed, for example a folding telescoping umbrella.

2. Marketplace Competition

This type of product is generally referred to as an "ITR" (invisible thread reel), and there are currently several others in the marketplace. Out of the current ITR's available there are two different types of operational designs:

Type A

The majority of previous ITR's use a rubberband (internally secured on two sides with a spooler fastened around the middle) to provide tension to the thread. When the thread is extended it unwinds and causes the spooler to rotate and the rubberband to twist. The uses and applications for this type of ITR are limited by the fact that the tension varies according to the amount of twist in the rubberband so that the thread never has an even amount of tension.

Type B

A few motorized ITR's have been developed over the years but they have minimal directional control over the thread, and concealment is also difficult. This is due to a combination of spooler placement (located in the center of the devices) and the opening that thread moves through (not adjustable). Both of these drawbacks cause difficulty for the magician during operation and limit the number of ways that they can be used during a performance.

Benefits of Invention

Due to the even and consistent thread tension (that the electric motor provides) and the operational distances which can be achieved (up to 25 feet) there will be many more uses then have ever been possible before with this type of device. The even thread tension and operational distance represent a vast improvement in functionality over any other product or device which performs a similar function, and will almost certainly revolutionize every field of magic in which it is used.

This invention uses novel and previously unimplemented approaches to resolve the following four problems. The first three are endemic, in one form or another, to all other devices currently available for use in similar applications, and the fourth is specific to this invention in particular.

Existing Problems

1) Inconsistent and uneven thread tension when used to control the motion of small objects.
2) Knotting, snagging, catching, sticking, tangling or locking up in any way during multiple instances of winding and unwinding the thread.
3) Inability to control the direction (and angle) that the thread is pointing towards during the process of winding and unwinding to a spooler (while in use during a performance).
4) Finding enough space in the cap of a standard size ink writing pen so that an electrical, mechanical, or electronic device (complete with all necessary components and batteries) can be placed inside.

Solutions to the Above Problems (Listed in the Same Order)

1) A battery electric motor that has a known (uniform and constant) output of mechanical force is used to generate even continuous tension. The tension is transferred to the thread through a spool around which the thread is wound.
2) The thread is precisely controlled as it feeds onto the spooler so that it is wound in an even and uniform manner that prevents knots and snags from forming during the spooling process.
3) There is a molded plastic covering fitted over the spooler which has a small notch through which the thread can pass. The notch on this component can be rotated (in a complete circle) to change the orientation and direction of the thread during the spooling process.
4) The main body of the pen is divided into two fitted sections and can be collapsed when one section is pushed into the other. There is an internal spring that causes the two sections of the pen to un-collapse whenever a locking device is removed. Since the pen body collapses extra room is created in the cap of the pen.

BRIEF DESCRIPTION OF DRAWINGS

The illustrations and diagrams set out herein are for the purpose of detailing the structural, functional and aesthetic parameters embodied in this particular version of a normal-looking writing pen with a motorized thread reel hidden inside the cap.

In addition to the pen/reel configuration detailed herein the same reel mechanism could also be used separately without the pen. Additionally, key design concepts such as the thread spooling mechanisms could be successfully applied in other configurations, for instance a stand-alone version of the same reel could be combined with a hands-free controlling mechanism, instead of the mechanical switch detailed herein, and a larger power source. One example of a hands-free controlling mechanism that could be used in a future variation of this device would be an electronic microchip attached to the motor assembly that would remember and keep track of the number of rotations that the spooler completed while thread was unwinding from the spool, and when the thread was winding back to the spool the microchip would shut the motor down when an equal number of reverse rotations was reached.

Figure 1:
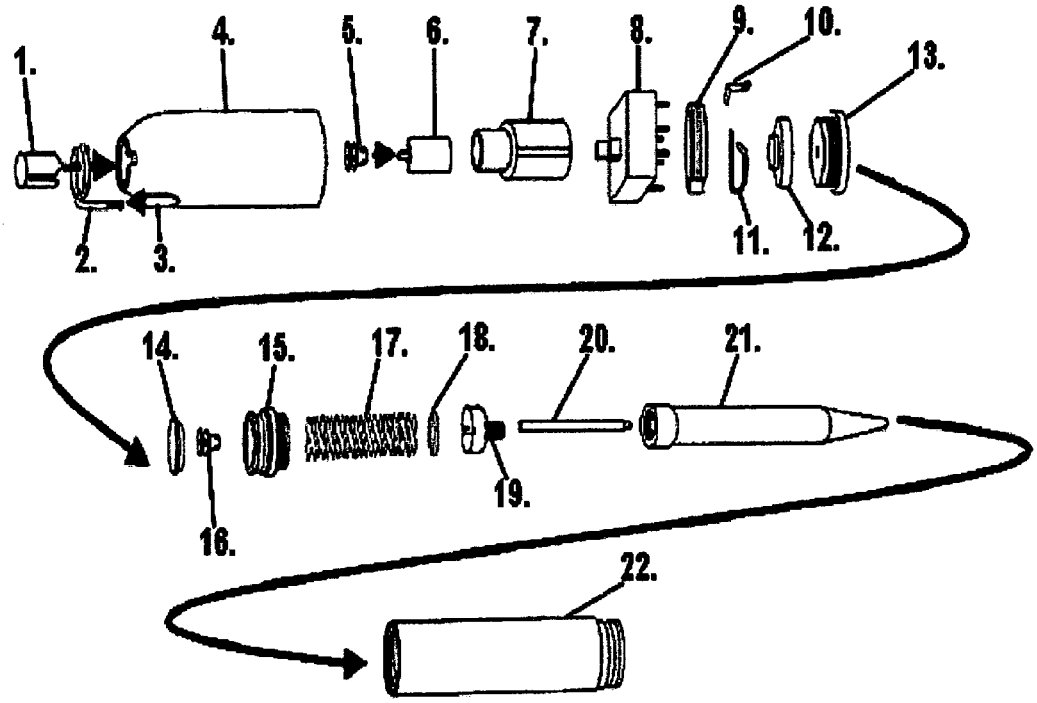

The current configuration is comprised of the following:

FIG. 1—Exploded view of the inventions 22 components as follows:

1) Button Cap spooler covering and thread directional controller.
2) Pocket Clip for attaching the pen to clothing.
3) Pocket Clip Protector for prevention damage to clothing when attached.

4) Pen Cover housing for motorized spooling mechanism.
5) Spooler around which thread is wound.
6) Motor provides mechanical force to turn the spool.
7) Motor Sleeve prevents improper thread spooling and holds the motor.
8) Switch is attached to the motor housing and provides on/of function.
9) Switch/Battery Interface Disk supports the battery contact terminals.
10) Positive Battery Terminal provides contact to the battery.
11) Negative Battery Terminal provides contact to the battery.
12) #357 Button Cell Battery electrical power source.
13) Cover Insert Battery Retainer holds the battery in place.
14) Main Body End Cap Cover holds the spare spooler in its compartment.
15) Main Body End Cap seals the end of the pen body.
16) Spare Spooler for replacement of main spooler.
17) Retracting Body Extender Spring causes the pen body to telescope.
18) Extender Spring Slip Washer prevents the extender spring from catching.
19) Retracting Body Ink Cartridge Retainer holds the ink cartridge in place.
20) 1.95" Ink Cartridge provides writing utility and can be replaced.
21) Retracting Body Housing inner-segmented portion of main pen body.
22) Main Body Housing outer-segmented portion of main pen body.

Figure 2:
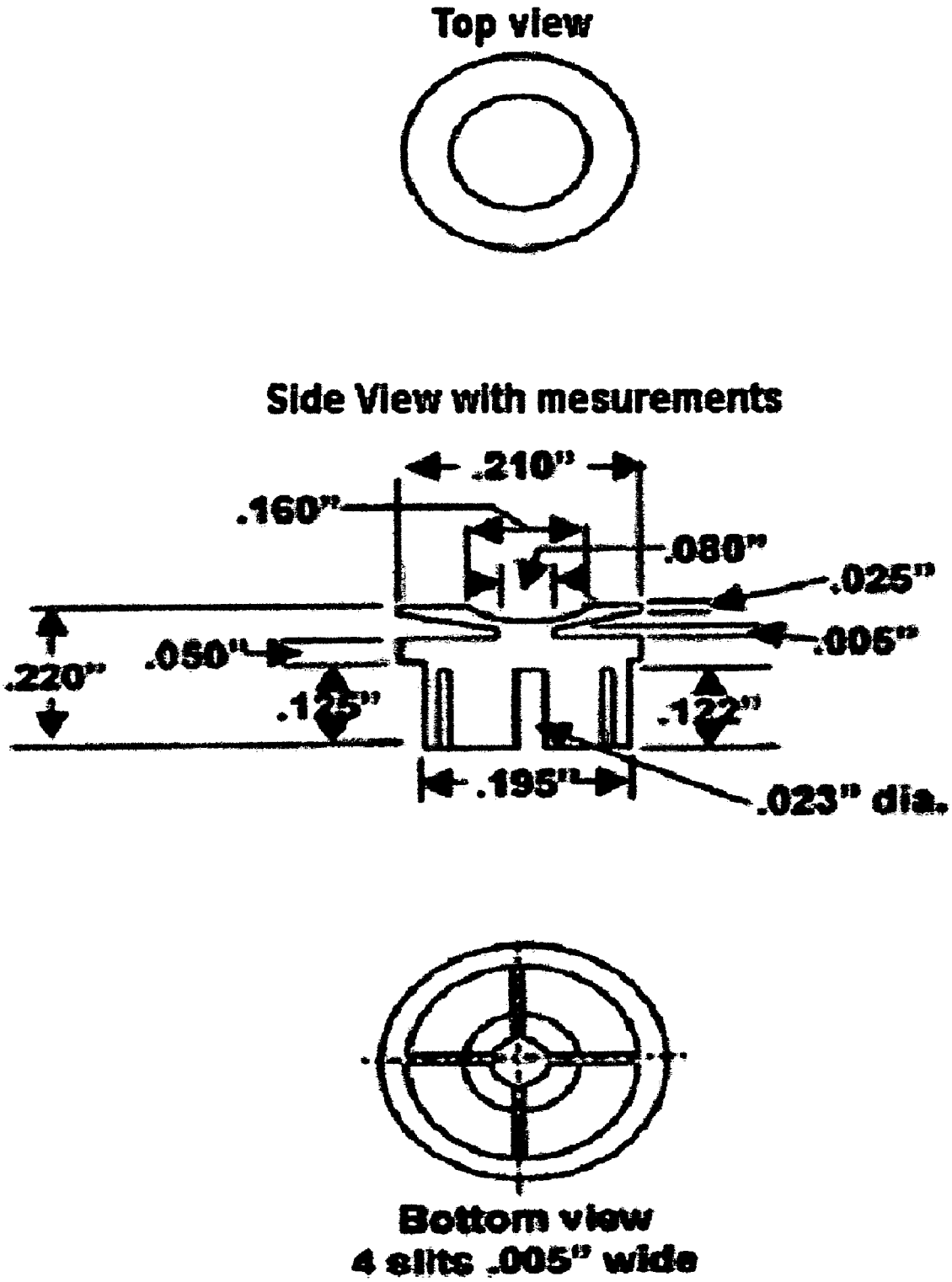

FIG. 2—Spooler (Close-up Detail View with precise measurements)

Figure 3:
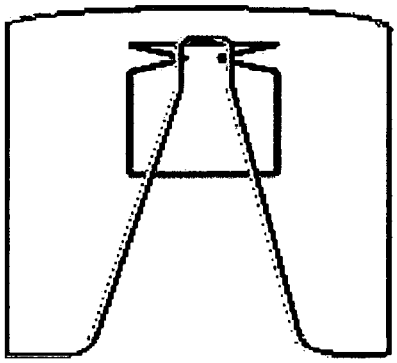

FIG. 3—Button Cap (Close-up Detail View)

DETAILED DESCRIPTION OF THE DRAWINGS

1) BUTTON CAP—This cylindrical plastic cap is designed to look like the button on a normal retractable pen. It fits onto the motor housing and completely covers the spooler. A small notch along the side of button cap(1) allows thread to spool through whenever the motorized reel mechanism is activated. All of the edges are smooth and rounded so the super-thin thread used by the reel is less likely to be cut. The notch is wider at the base and narrows near the top in order to help the thread into position as the cap is slid onto the motor housing(7). Sufficient clearance on the inside of the cap allows the spooler to spin freely at all times. With the switch positioned off: the notch is lower and hidden from view inside the main pen cover(4). With the switch positioned on: the notch is higher and peeks up over the main pen cover(4) enough to allow an opening for thread to spool through.

2) POCKET CLIP—Standard design clothing clip. Comprised of a rigid metal shaft that is covered by a plastic pocket protector(3). The clip has a spring-like ability to snap back into position, and this results in a firm grip slid onto an article of clothing. The pocket clip(2) can also be used for attachment to any thin object as necessary.

3) POCKET PROTECTOR—A plastic pocket protector(3) that covers most of the exposed metal of the pocket clip in order ensure that the fabric is not damaged as it is fastened to clothing. The pocket protector(3) has a small rounded bump on the underside to help provide a more secure grip, and is designed with the tip flattened perpendicularly to the body of the pen. The shape of the pocket protector(3) tip is custom designed. Specific contours and angels were used prevent the thread from sliding underneath the clip and getting caught accidentally.

4) MAIN PEN COVER—Designed to look like a standard pen cap that would fit onto the pen and prevent the ink from drying up, but it secretly contains the reel mechanism hidden from view. The interior is threaded so the battery retainer insert(13) can screw in place and hold the battery against the electrical contacts.

5) SPOOLER—Thread is wrapped around a specially shaped groove on the spooler and it is seated on the axel of the motor. Rotational torque from the motor is transferred through the spooler into the thread in the form of a continuous pulling force. The constant and even tension created in the thread is vastly superior to operational parameters offered by any previous non-motorized devices.

6) MOTOR—An electric motor is used to spin the thread spooler and provide a constant and even amount of tension when in operation. The motor is attached to the base of the switch by a pair of (+−) wires. There are two narrow grooves on the interior of the pen which allow the wires enough room to avoid getting pinched and broken when the motor assembly slides up and down.

7) MOTOR HOUSING—The motor(6) fits inside the plastic motor housing(7) sleeve and is held in place. The rotating axel of the motor is aligned exactly parallel to the inside of the main pan cover(4) allowing the entire assembly to slide up and down without ever becoming misaligned with the inside of the main pan cover(4). The spooler is seated on the motor, and the thread groove remains level in relation to the top of the main pan cover(4) at all times.

8) SWITCH—A dual-setting toggle switch is used for controlling operational the state of the motor (on/active and off/passive) depending on the requirements of a given application or routine. The toggle-button of the switch(8) is securely fitted into and then glued to the bottom of the motor housing(7). The two align vertically allowing the motor housing to slide easily up and down inside the pen cover(4) without catching. The base of the switch(8) has electrical connectors securely fastened and soldered to the (+/−) battery contacts. Furthermore, the switch(8) is designed so the toggle-button is raised up and extends out when switched into the on position. The opposite is also true because while switched into the off position the toggle-button is lowered down, and sits further inside the body of the switch. This positional difference is very important because while the motor(6) assembly is raised up the button-cap(1) covering the spooler(5) is also raised, allowing enough space for thread to freely spool through the small opening formed at the juncture of the button-cap(1) notch and the pen cover(4).

Important conceptual note regarding mechanism controlling devices: currently the switch operated manually via hand-activation whenever needed, but other methods of controlling the device could also prove to be useful Future versions could include more technologically advanced switching mechanisms. For example the use of a specially programmed microchip, in combination with a sensing device could allow for hands-free switching. Possible other variations include using timers or motion detectors as switches).

9) BATTERY TERMINAL SUPPORT—Small plastic part that fits underneath the metal battery contacts and provides structural support. Designed to keep the battery terminals(10/11) from bending due to pressure applied by battery when the battery retainer insert(13) is tightly screwed in.

10) POSITIVE BATTERY TERMINAL—A rigid strip of electrically conductive metal used to connect the positive side of the battery(12) to the positive input of the switch(8). The component is specially shaped and deliberately placed in a manner that creates a firm and clean contact with the battery.

11) NEGATIVE BATTERY TERMINAL—A rigid strip of electrically conductive metal used to connect the negative side of the battery(12) to the negative input of the switch(8). The component is specially shaped and deliberately placed in a manner that creates a firm and clean contact with the battery.

12) BATTERY—Standard #357 button cell watch battery is used as a power source for operating the motor.

13) BATTERY RETAINER INSERT—A circular plastic component with external threads on the top allowing it to be screwed into the main pen cap cover(4) and hold the battery in place. There are also recessed threads on the underside that the main body housing(22) screws into when the device is fully assembled.

14) MAIN BODY END CAP COVER—Thin plastic covering for the secret auxiliary spooler compartment. Snaps on and off easily and hold securely. Also has a small indentation for hooking a fingernail under when opening.

15) MAIN BODY END CAP—The base of the main body housing(2) is capped of by the main body end cap(15).

16) AUXILARRY SPOOLER—Spare spooler that can be loaded with thread and used as a replacement for the main spooler whenever the need arises.

17) EXTENDER SPRING—This spring provides the force which extends the retracting body housing(21) from the main body housing(22) when the main pen(4) cover is removed.

18) EXTENDER SPRING SLIP WASHER—This thin separator disk prevents any rotational torque from being transferred to the retracting body housing(21) assembly from the spring while it is tightly coiled after the main pen cap(4) is screwed onto the interior of the battery retainer insert(13).

19) INK CARTRIDGE RETAINER—Small plastic cap that screws into the retracting body housing(21) and holds the ink cartridge(20) in place.

20) INK CARTRIDGE—A disposable ink cartridge(20) fits inside the retracting body housing(21) and is held in place by the ink cartridge retainer(19). This allows for normal use as a writing instrument, and thus helps alleviate any possible suspicions about hidden internal mechanisms or devices contained therein. Designed to use standard size replacement cartridges which can be bought at most office supply stores.

21) RETRACTING BODY HOUSING—The retracting body housing(21) slides into the main body housing(22) when the main pen cap(4) is screwed onto the main body housing (22). Both pieces are approximately the same length and fit together in a smooth and precise manner. When the main pen cap(4) is removed the retracting body housing(21) quickly slides out due to internal pressure applied by the extender spring. This extension happens so quickly that it creates the illusion of a normal full-length pen being withdrawn from its cap.

22) MAIN BODY HOUSING—This is the primary structural component of the invention. Externally threaded on one end so it can be screwed into the main pen cap(4), and internally threaded on the opposite end so the main body end cap cover(14) can be screwed into it. The interior of the main body housing(22) is fitted so that the retracting body housing(21) is able to slide easily inside and leave a minimum of wasted space.

I claim:

1. A miniature spooling apparatus, comprising:

a housing having a mechanically powered spool therein; and a cover apparatus with an open end, the cover apparatus being formed such that it covers a portion of the mechanically powered spool and being attached with the housing such that a space exists between the cover apparatus and the spool to allow for rotation of the spool therein;

wherein the cover apparatus is formed to resemble an item selected from a group consisting of a pen's push button and a pen's cap;

wherein the mechanically powered spool includes thread wrapped around the spool;

wherein the cover apparatus is formed to include a notch that extends from the open end such that when the cover apparatus covers a portion of the spool, thread can pass freely through the notch; and wherein the spool includes a rotational axis and the cover apparatus is attached with the housing such that it is rotatable in relation to the housing about a rotational axis, and where the cover apparatus is attached with the housing such that the rotational axis of the cover apparatus is approximately parallel to the rotational axis of the spool; and wherein the notch is formed in the cover apparatus such that the notch is aligned with the spool when the cover apparatus is covering a portion of the spool, such that when thread is spooled from the spool and through the notch, rotation of the cover apparatus allows a user to control a direction in which the thread spools.

2. A miniature spooling apparatus as set forth in claim 1, wherein the housing is formed to simulate an appearance of an ink pen, thereby covering the spool and disguising the spooling apparatus as an ink pen.

3. A miniature spooling apparatus as set forth in claim 2, wherein the spool has a circumference and includes an exterior groove that runs around the circumference, the exterior groove being tapered to a point, thereby promoting an even buildup of the thread around the spool.

4. A miniature spooling apparatus as set forth in claim 3, wherein the spool has a concave top, and where the spool and cover apparatus are formed such that a space exists between the top of the spool and the cover apparatus when covering a portion of the spool, whereby a user may use an adhesive with the concave top to attach the thread with the spool.

5. A miniature spooling apparatus as set forth in claim 4, further comprising a motor encased within the housing for operating the mechanically powered spool, the motor having an axle and the spool having a bottom with slits cut therein for engaging with and securely affixing the spool with the axle.

6. A miniature spooling apparatus as set forth in claim 5, further comprising an electro-mechanical switch encased within the housing and being operable for activating the motor and causing the mechanically powered spool to spool the thread.

7. A miniature spooling apparatus as set forth in claim 6, further comprising an electro-mechanical switch encased within the housing and being operable for activating the motor and causing the mechanically powered spool to spool the thread.

8. A miniature spooling apparatus, comprising:

a housing having a mechanically powered spool therein; and a cover apparatus with an open end, the cover apparatus being formed such that it covers a portion of the mechanically powered spool and being attached with the housing such that a space exists between the cover apparatus and the spool to allow for rotation of the spool therein;

wherein the spool includes a rotational axis and the cover apparatus is attached with the housing such that it is rotatable in relation to the housing about a rotational axis, and where the cover apparatus is attached with the housing such that its rotational axis is approximately parallel to the rotational axis of the spool; and wherein a notch is formed in the cover apparatus such that when thread is spooled from the spool and through the notch, rotation of the cover apparatus allows a user to control a direction in which the thread spools.

9. A miniature spooling apparatus, comprising:

a housing having a mechanically powered spool therein; and a cover apparatus with an open end, the cover apparatus being formed such that it covers a portion of the mechanically powered spool and being attached with the housing such that a space exists between the cover apparatus and the spool to allow for rotation of the spool therein; and further comprising a motor encased within the housing for operating the mechanically powered spool, the motor having an axle and the spool having a bottom with slits cut therein for engaging with and securely affixing the spool with the axle.

10. A miniature spooling apparatus as set forth in claim 9, further comprising an electro-mechanical switch encased within the housing and being operable for activating the motor and causing the mechanically powered spool to spool the thread.

11. A miniature spooling apparatus, comprising:

a housing having a mechanically powered spool therein; and a cover apparatus with an open end, the cover apparatus being formed such that it covers a portion of the mechanically powered spool and being attached with the housing such that a space exists between the cover apparatus and the spool to allow for rotation of the spool therein; and wherein the housing has an original length and is segmented into a top section and a bottom section, where the two sections are formed and connected such that the bottom section can be selectively slid into and out of the top section in a retracting and telescoping motion, thereby reducing and expanding, respectively, the length of the housing.

12. A miniature spooling apparatus, comprising:

a housing having a mechanically powered spool therein; and a cover apparatus with an open end, the cover apparatus being formed such that it covers a portion of the mechanically powered spool and being attached with the housing such that a space exists between the cover apparatus and the spool to allow for rotation of the spool therein; and further comprising a microchip connected with the motor and configured to record rotations of the spool while the thread is unwinding from the spool, such that when the thread is winding around the spool, the microchip is configured to deactivate the motor when an equal number of reverse rotations is reached.

13. A miniature spooling apparatus, comprising;

a housing having a mechanically powered spool therein;

thread wrapped around the spool;

a motor connected with the spool for powering the spool to wind the thread around the spool; and a microchip connected with the motor and configured to record rotations of the spool while the thread is unwinding from the spool, such that when the thread is winding around the spool, the microchip is configured to deactivate the motor when an equal number of reverse rotations is reached.

* * * * *